US009325043B2

(12) United States Patent
Katipally et al.

(10) Patent No.: US 9,325,043 B2
(45) Date of Patent: Apr. 26, 2016

(54) PHASE SHIFTING CIRCUIT INCLUDING AN ELONGATED CONDUCTIVE PATH COVERED BY A METAL SHEET HAVING STAND-OFF FEET AND ALSO INCLUDING A SLIDABLE TUNING MEMBER

(71) Applicant: Radio Frequency Systems, Inc., Meriden, CT (US)

(72) Inventors: Raja Reddy Katipally, Cheshire, CT (US); Jari Taskila, Meriden, CT (US)

(73) Assignee: Alcatel-Lucent Shanghai Bell Co., Ltd., Shanghai (CN)

( * ) Notice: Subject to any disclaimer, the term of this patent is extended or adjusted under 35 U.S.C. 154(b) by 136 days.

(21) Appl. No.: 13/952,197

(22) Filed: Jul. 26, 2013

(65) Prior Publication Data

US 2015/0028968 A1 Jan. 29, 2015

(51) Int. Cl.
*H01P 1/18* (2006.01)
*H01Q 3/32* (2006.01)

(52) U.S. Cl.
CPC . *H01P 1/184* (2013.01); *H01Q 3/32* (2013.01)

(58) Field of Classification Search
CPC ..... H01P 1/184; H01P 9/00; H01P 9/006; H01P 5/12
USPC ..... 333/161
See application file for complete search history.

(56) References Cited

U.S. PATENT DOCUMENTS

| | | | | |
|---|---|---|---|---|
| 3,146,413 | A * | 8/1964 | Butler | 333/161 |
| 6,512,426 | B1 | 1/2003 | Wixforth | |
| 2003/0016097 | A1 * | 1/2003 | McKinzie et al. | 333/161 |
| 2011/0063049 | A1 * | 3/2011 | Bradley et al. | 333/161 |
| 2011/0140805 | A1 * | 6/2011 | Liu et al. | 333/161 |
| 2012/0056692 | A1 * | 3/2012 | Moon et al. | 333/136 |
| 2012/0098619 | A1 * | 4/2012 | Oo et al. | 333/161 |
| 2012/0194295 | A1 * | 8/2012 | Chen et al. | 333/156 |
| 2013/0154893 | A1 * | 6/2013 | Ilnar et al. | 343/853 |

FOREIGN PATENT DOCUMENTS

WO WO 01/03233 1/2001

* cited by examiner

*Primary Examiner* — Benny Lee
(74) *Attorney, Agent, or Firm* — Capitol Patent & Trademark Law Firm, PLLC

(57) ABSTRACT

Multiple phase shifting elements which include electrically conductive, slidable tuning members may be placed on a single circuit board. The elements may be used to adjust the phase of signals propagating through a multi-element antenna array.

19 Claims, 9 Drawing Sheets

PHASE SHIFTING CIRCUIT INCLUDING AN ELONGATED CONDUCTIVE PATH COVERED BY A METAL SHEET HAVING STAND-OFF FEET AND ALSO INCLUDING A SLIDABLE TUNING MEMBER

INTRODUCTION

To adjust the phase of antennas in a multi-antenna element array typically requires the use of a dielectric slab tuner or a traditional "line stretcher". Both require multiple parts to assemble. Additionally, during and after assembly the many parts must be aligned properly in order for a tuner or line stretcher to work effectively.

Accordingly, it is desirable to provide methods and devices for adjusting the phase of elements of a multi-antenna element array that make use of fewer components and require less alignment.

SUMMARY

In accordance with embodiments of the invention, multiple phase shifting circuit elements each comprising electrically conductive, slidable tuning members may be placed on a single circuit board. The elements may be used to adjust the phase of signals propagating through a multi-element antenna array.

One particular embodiment may comprise a phase shifting circuit element that comprises: a circuit board comprising a surface, and an elongated electrically conductive path on the surface; a cover disposed over and electrically connected to the conductive path, the cover comprising a bottom surface substantially separated from the electrically conductive path to define an elongated receiving space there between; and an electrically conductive tuning member slidably receivable within the receiving space.

In alternative embodiments, the tuning member may be electrically coupled, or capacitively coupled, to the conductive path. Further, the tuning member may comprise a circuit board substrate, where the substrate comprises an electrically conductive path on a surface.

In an additional embodiment, a phase shifting circuit element may additionally comprise an insulating layer for covering the electrically conductive path. Such an insulating layer may comprise a dielectric insulator. In another embodiment, the insulating layer (e.g. dielectric insulator) may cover the bottom surface of the cover.

The cover of a phase shifting circuit element may comprise a substantially planar conductive metal sheet comprising a plurality of stand-off feet formed at edges thereof, the feet configured for mounting the metal sheet to a circuit board and for spacing the cover apart from the electrically conductive path.

In addition to phase shifting circuit elements, the present invention provides for phase shifting circuit networks. For example, one embodiment of such a network may comprise: a first circuit board comprising a surface, and a plurality of power dividers formed substantially side-by-side on the surface. In this embodiment, each of the power dividers may comprise: a pair of parallel elongated electrically conductive paths formed on the surface, the conductive paths being oriented parallel to one another and comprising first and second ends, the first ends being electrically connected to one another and to a signal tap; and a capacitive cover disposed over, and electrically connected to, each of the electrically conductive paths, each capacitive cover comprising a bottom surface substantially separated from a corresponding electrically conductive path to define an elongated receiver space therebetween; a second circuit board comprising a surface and a side edge; and a plurality of tuning elements formed on the second circuit board. Further, each of the tuning elements may comprise: a pair of electrically conducting arms extending from the side edge the arms being oriented parallel to one another and comprising first and second ends, the first ends being electrically connected to one another.

In a further embodiment, the arms of the tuning elements may be operable to slidably move into receiving spaces of the power dividers. Alternatively, each arm of a tuning element may be operable to move into a receiving space of a different one of two adjacent power dividers.

In an embodiment, the received tuning elements may serially connect the power dividers to form a serial array of power dividers.

The plurality of power dividers in an inventive phase shifting circuit network may comprise a first set of power dividers disposed along a first edge of a circuit board, and a second set of power dividers disposed along an opposite second edge of the circuit board, the first and second sets of power dividers configured in a mirror-image arrangement such that receiving spaces, of the power dividers of the first set, face inward toward receiving spaces of the power dividers of the second set.

The plurality of tuning elements formed on the second circuit board of a phase shifting circuit network may comprise a first set of tuning elements comprising electrically conducting arms extending outward from a first side edge of the second circuit board, and a second set of tuning elements comprising electrically conducting arms extending outward from a second side edge of the circuit board opposite the first side edge.

Phase shifting circuit networks provided by the present invention may additionally comprise a housing substantially enclosing first and second circuit boards, and/or a plurality of coaxial cable mounting clips corresponding to signal taps. Each coaxial cable mounting clip may comprise a sheet metal strip having a downward bent front and rear ends and channels to fit over a coaxial cable. The front end may comprise a soldered connection to a shielding layer of the coaxial cable, while the rear end may comprise a clipped on connection to an insulating jacket of the coaxial cable.

In additional embodiments, one or more mounting elements maybe located on a top surface of the clips to accommodate mounting or clamping screws. The mounting elements maybe are screw holes, for example.

In additional to the inventive devices set forth above and herein, the present invention provides for inventive methods related to such devices. One such method may be directed at a method for providing phase adjustments in a multi-element antenna array. This method may comprise: configuring a first circuit board comprising a surface, and an electrically conductive signal path on the surface; forming a plurality of power dividers substantially side-by-side on the surface, each of the power dividers comprising: a pair of parallel elongated electrically conductive paths formed on the surface, the conductive paths being oriented parallel to one another and comprising first and second ends, the first ends being electrically connected to one another and to a signal tap; and a capacitive cover disposed over, and electrically connected to, each of the electrically conductive paths, each conductive cover comprising a bottom surface substantially separated from a corresponding electrically conductive path to define an elongated receiving space therebetween; configuring a second circuit board comprising a surface and a side edge; and configuring a plurality of tuning elements formed on the second circuit board to serially connect the power dividers, each of the tuning elements comprising a pair of electrically conducting arms extending from the side edge, the arms being oriented parallel to one another and operable to slidably move into receiving spaces of the power dividers and comprising first and second ends, the first ends being electrically connected to one another.

These and other methods, features, aspects, and advantages of the present invention will become better understood with regard to the following description, appended claims, and accompanying drawings.

DETAILED DESCRIPTION, WITH EXAMPLES

Figure 1A:
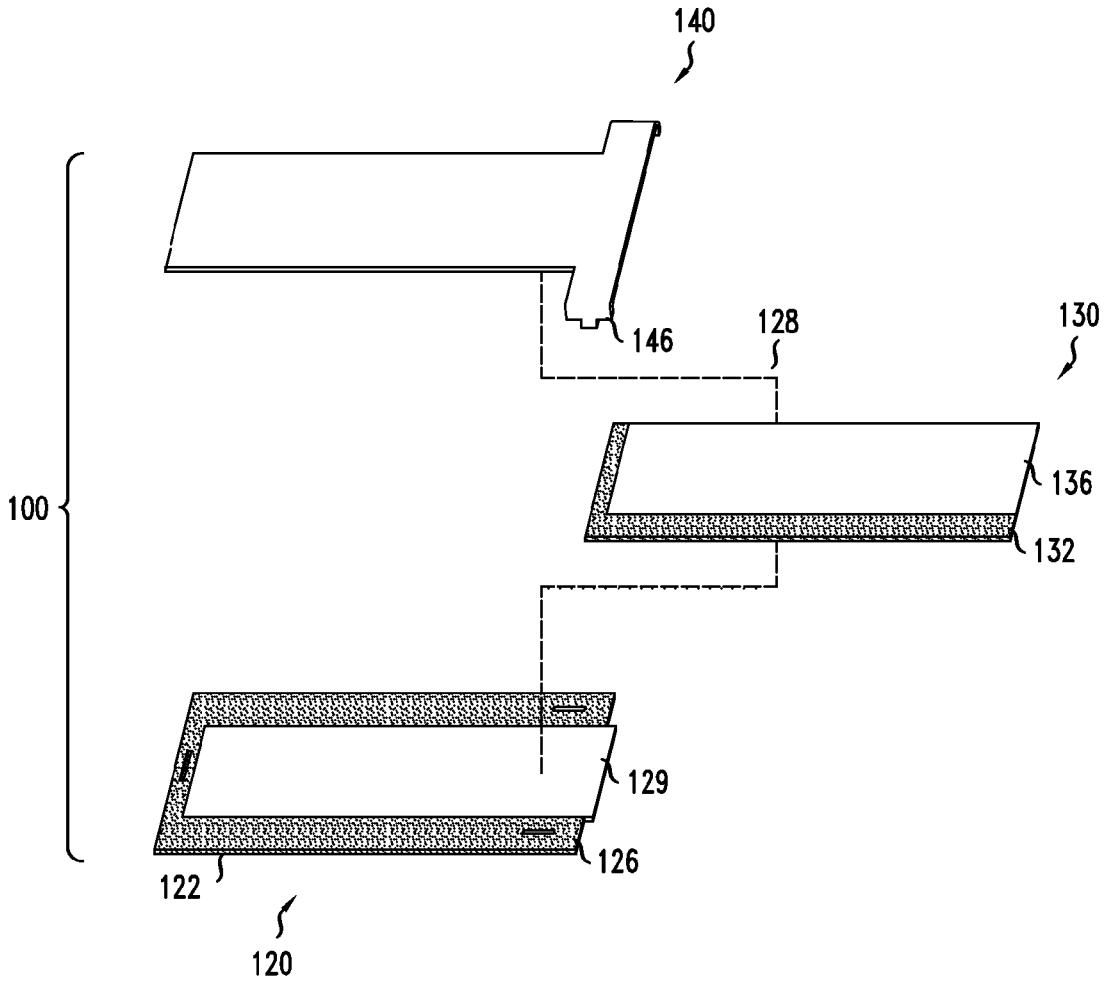
FIG. 1A is an exploded view of a single phase shifting element of the present invention.
Figure 1B:
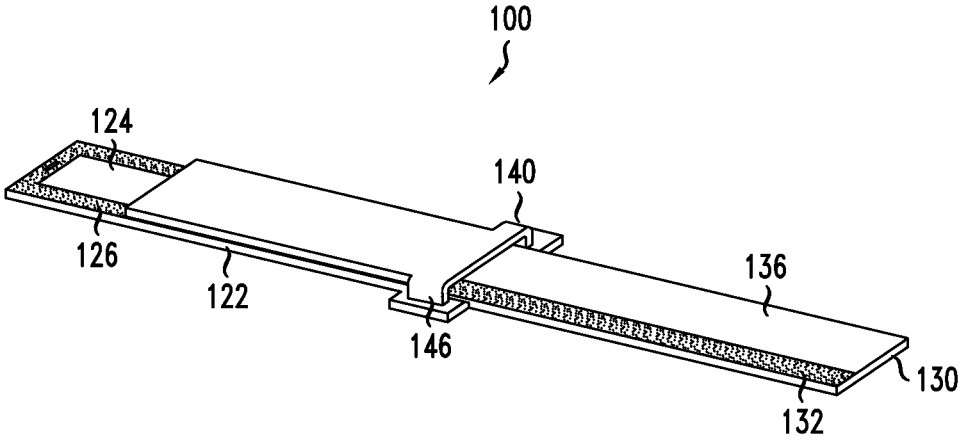
FIG. 1B is an assembled view of the single phase shifting element of FIG. 1A.
Figure 1C:
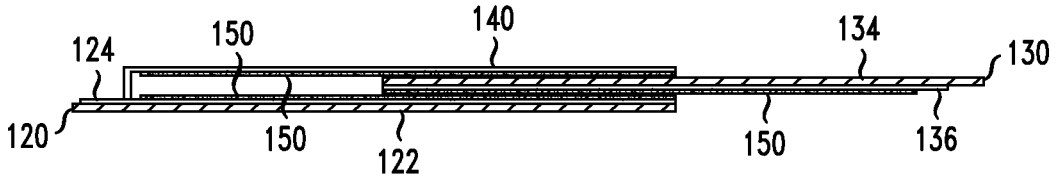
FIG. 1C is a cross section of a single phase shifting element of FIG. 1B.

Referring to FIGS. 1A through 1C, there is depicted a phase shifting circuit element 100 (see FIGS. 1A and 1B) that may comprise a first element 120 (see FIGS. 1A and 1C) formed on a first circuit board 122, and a second element 130 electrically or capacitively coupled to the first element 120 in accordance with one embodiment of the invention. More particularly, the first element 120 comprises an elongated electrically conductive path 124 (see FIGS. 1B and 1C) formed on a surface 126 (see FIGS. 1A and 1B) of the first circuit board 122 (terminating at an edge 129 shown in FIG. 1A), and a cover 140 disposed over the conductive path 124 to form a receiving space 128 (see FIG. 1A), while the second element 130 is configured to be slidably received within the receiving space 128. Cover 140 comprises a plurality of stand-off "feet" 146 (see FIGS. 1A and 1B) that contact the first circuit board 122 and assist in defining the dimension of the receiving space 128.

The cover 140 may be a capacitive cover disposed over and electrically connected to the conductive path 124. The capacitive cover may comprise a bottom surface 144 (see FIG. 2A) substantially separated from the electrically conductive path 124 to define the receiving space 128 between the capacitive cover 140, and the conductive path 124 on the first circuit board 120.

The second element 130 may comprise an electrically conductive tuning member 132 (see FIGS. 1A and 1B) slidably receivable within the receiving space 128. The tuning member 132 may be a piece of a conductive material formed to be slidably received in the receiving space 128, or it may be a second printed circuit board or a portion of a second printed circuit board 134 having a conductive trace 136 formed thereon, and configured to be slidably received in the receiving space 128. For example, the tuning member 132 may be formed as an arm extending from an edge of the second circuit board 134, wherein the conductive trace 136 is formed to extend along the arm.

Dimensionally, in one embodiment the receiving space 128 may be an elongated slot. Further, the first element 120, second element 130, and their respective components, may be dimensioned in accordance with slidably interconnected relationships.

Figure 2A:
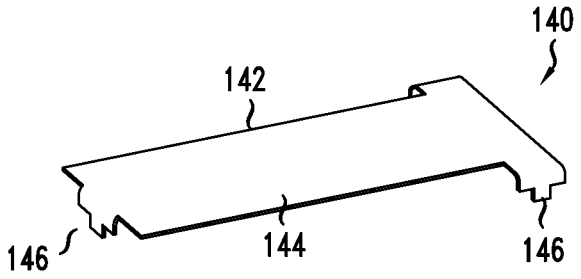
FIG. 2A is bottom perspective view of a capacitive cover of a phase shifting element.

Referring to FIG. 2A, in one embodiment the capacitive cover 140 may comprise a substantially planar conductive metal sheet 142 (for example, copper or the like) having similar dimensions to the conductive path 124 (shown in FIGS. 1B and 1C) formed on the first circuit board 122 (shown in FIGS. 1A-1C). The cover 140 may further comprise a plurality of stand-off "feet" 146 formed at edges, such that the stand-off feet 146 may be configured for mounting the metal sheet 142 to the first circuit board 122 (shown in FIG. 1B). The cover 140 may be electrically connected to, and spaced apart from, the electrically conductive path 124. In an embodiment of the invention, the elongated receiving space 128 (shown in FIG. 1A) may be formed between the capacitive cover 140 and the conductive path 124.

Figure 2B:
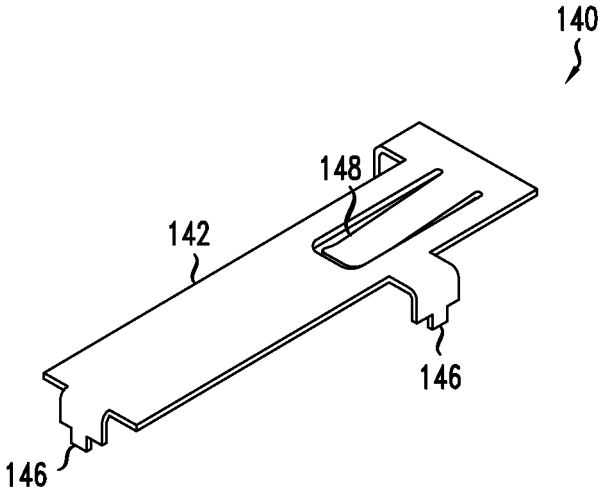
FIG. 2B is top perspective view of another embodiment of a capacitive cover of a phase shifting element.

Referring next to FIG. 2B, another embodiment of a capacitive cover 140 may comprise a spring clip element 148, which may be helpful in holding the tuning member 132 (see FIGS. 1A and 1B) in position within the receiving space 128 (shown in FIG. 1A). As illustrated, the spring lip element 148 may be, for example, a strip defined within the conductive metal sheet 142, that is bent inward into the receiving space 128, such that the spring clip element 148 may be configured to press against the tuning member 132 when the tuning member 132 is moved into the receiving space 128. The cover 140 may further comprise feet 146 that may be offset from the end of the capacitive cover 140. It should be understood that the stand-off feet 146 may be located at any suitable position on the capacitive cover 140. Offset stand-off feet 146 may permit closer positioning of capacitive covers 140 on a circuit board.

Although the conductive path 124 and the tuning member 132 may be left uninsulated (as shown in FIG. 1B) so that the tuning member 132 may be electrically coupled to the conductive path 124 via a metal-to-metal electrical contact, for example, in an alternative embodiment of the invention as shown in FIG. 1C, both the tuning member 132 (see FIG. 1B) and the conductive path 124 (as well as the bottom side of capacitive cover 140 which is then in contact with the top surface 134 of the second element 130) may be covered by an insulator layer 150. The insulator layer 150 may comprise, for example, a dielectric insulator such that the tuning member 132 may be capacitively coupled to the conductive path 124. In addition to various conventional insulating materials (including, although not limited to, materials such as Kapton), a solder mask layer can be used to form a suitable insulator 150 at a low cost.

Figure 3:
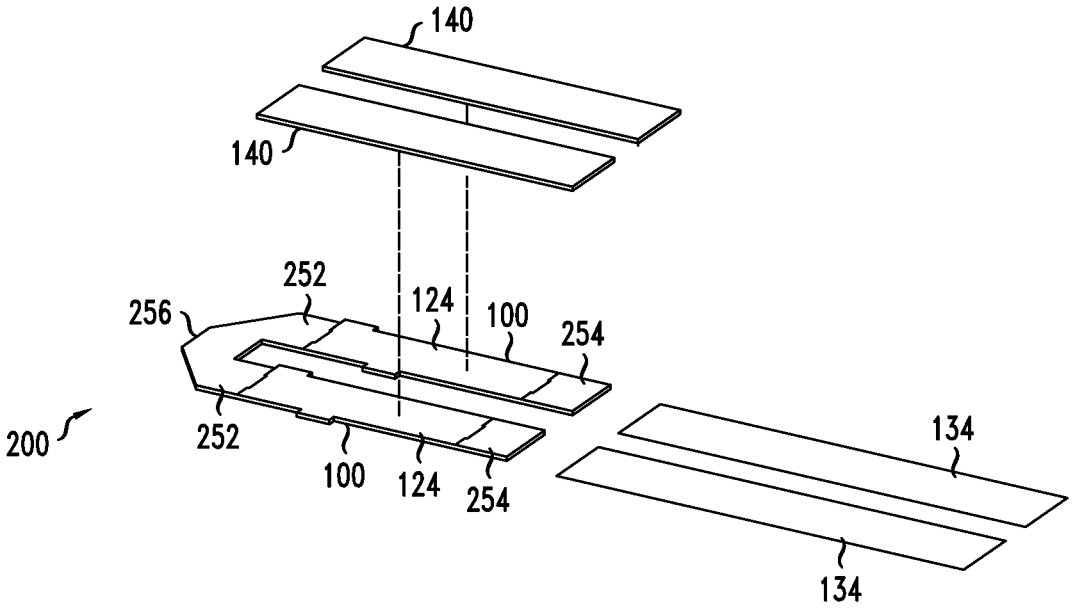
FIG. 3 is an exploded view of a single power divider element formed of a pair of phase shifting elements.

In embodiments of the invention discussed below, the devices described herein may comprise an inventive "trombone type line stretcher" that is a part of a multi-element antenna array. In an embodiment of the invention as shown in FIG. 3, the phase shifting circuit element 100 may be connected to, or otherwise associated with, a signal path in order to provide phase-shifting (or "line stretching") within the signal path, and may be formed directly on a printed circuit board. In accordance with embodiments of the present invention, once element 100 is connected to or associated with a signal path, the phase of a signal propagating along the signal path may be varied by varying the position of the tuning member 132 within the receiving space 128 (see FIG. 1A).

Referring now to FIG. 3 there is depicted another embodiment of the invention. In particular, FIG. 3 depicts a pair of side-by-side phase shifting circuit elements 100 substantially as described above. The elements 100 may be electrically connected together at one end to form a power divider element 200. The power divider 200 may comprise a pair of parallel, elongated electrically conductive paths 124 formed on a first circuit board 122, such that the conductive paths 124 may be oriented side-by-side and substantially parallel to one another. The electrically conductive paths 124 may comprise first and second ends 252, 254, wherein the first ends 252 may be electrically connected to one another to define a "U" shaped conductive path arrangement. A signal tap 256 may be provided in conjunction with the electrical connection between the electrically conductive paths 124. In an embodiment of the invention, an input signal applied to one of the second ends 254 may follow the "U" shaped conductive path, including a path to the signal tap 256.

A capacitive cover 140 may be disposed over, and electrically connected to, each of the electrically conductive paths 124, in a manner as described above, wherein each of the capacitive covers may comprise a bottom surface substantially separated from a corresponding electrically conductive path 124 to define an elongated receiving space 128 (shown in FIG. 1A). A tuning element 134 may be provided in conjunction with each of the electrically conductive paths 124. Each tuning element 134 may be configured to be slidably received within a corresponding receiving space 128.

Figure 4:
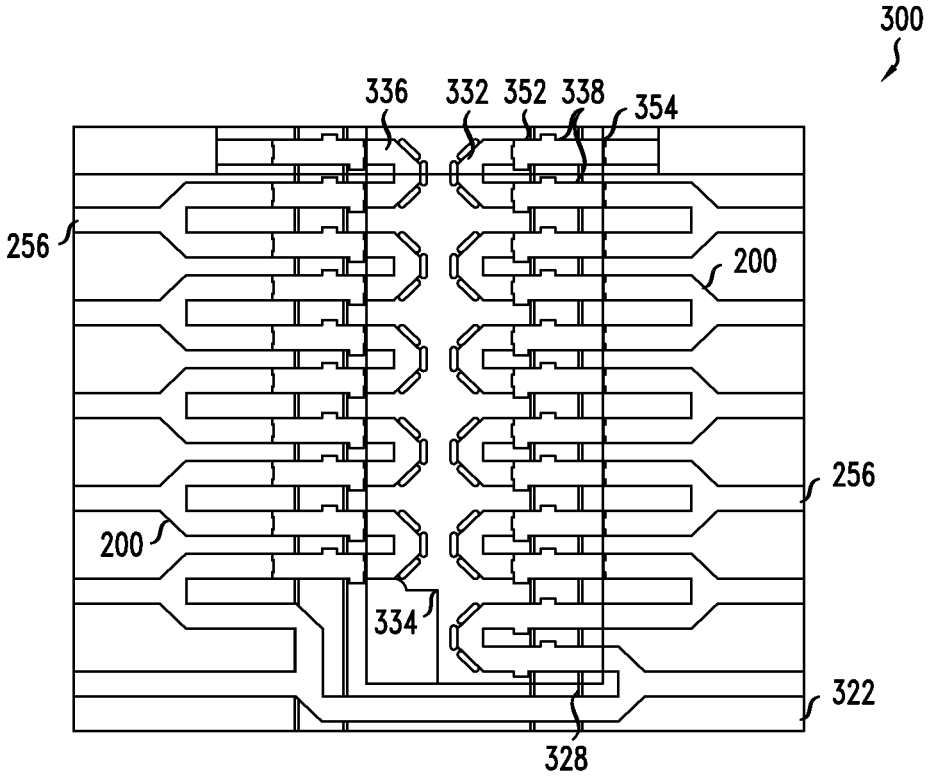
FIG. 4 is a perspective view of a phase shifting network comprising a plurality of phase shifting elements.

Turning next to FIG. 4, a progressive phase shifting network 300 is shown. The network 300 may comprise a plurality of power divider elements 200 substantially as described above. It should be noted that though only a few elements 200 are labeled in FIG. 4, this is for the sake of clarity. In actuality, the embodiment in FIG. 4 depicts many more elements 200 than those that have been so labeled. The network 300 may be configured as a phase shifting network connected to a multi-element antenna array in order to tune one or more antennas within the array by adjusting the phase of a signal being propagated by an antenna, for example.

In this embodiment, the plurality of power divider elements 200 may be configured substantially side-by-side on a first circuit board 322. The elements 200 may comprise a plurality of tuning elements 332. As with the power divider elements 200, only a few tuning elements 332 have been labeled in FIG. 4, it being understood that many more are depicted, but not labeled, in the embodiment shown in FIG. 4. Each of the tuning elements 332 may comprise a pair of electrically conducting arms 338 oriented parallel to one another, with each arm 338 having first and second ends 352, 354, where the first ends 352 may be electrically connected to one another. That is, each of the plurality of tuning elements 332 may generally define a "U" shaped conductor. In accordance with an embodiment of the invention, the tuning elements 332 may be formed together on a single, second circuit board 334, where arms 338 of the second circuit board 334 may extend from a side edge of the second circuit board 334. Further, conductive circuit traces 336 may be formed on the arms to form electrically conducting arms 338. The arms 338 may be configured to be slidably received in the receiving spaces 328 of the power divider elements 200 formed on the first circuit board.

More specifically, the arms 338 of the tuning elements 332 may be slidably received in receiving spaces 328 of the power divider elements 200 such that each arm 338 of a tuning element 332 may be received in a receiving space 328 of a different one of two adjacent power divider elements 200. Hence, a plurality of serially connected power divider elements 200 may be formed.

In a further refinement, the serially connected power divider elements 200 may be separated into two sets. Each set may be arranged along one of two opposite sides of the first circuit board 322, with the signal taps 256 extending to an edge of the first circuit board 322. The assemblies of the electrically conductive paths 124 (see FIGS. 1B and 1C), capacitive covers 140 (see FIGS. 1A-1C) and corresponding receiving spaces 128 (see FIG. 1A) may be directed toward the center of the first circuit board 322. That is, mirror image arras of power divider elements 200 may be arranged along opposite side edges of the first circuit board 322. A tuning element array may comprise a plurality of the "U" shaped conductors, extending outwardly from opposite sides of a second circuit board, with the arms of the "U" shaped tuning elements aligned with the receiving spaces 328 of the power divider elements 200. In an embodiment of the invention, moving the tuning element array towards a first one of the sets of the power divider elements 200, in effect, also moves the tuning element arms corresponding to that set further into the receiving spaces of the first set. At substantially the same time, the tuning element arms corresponding to a second one of the sets of the power divider elements 200 may be withdrawn from the receiving spaces of the second set. That is to say, as one set of tuning element arms are inserted into power divider elements to become part of a signal path created by the combination of arms and elements, another set of arms are being withdrawn from other power divider elements and removed from a signal path.

As noted above in association with FIGS. 1A-1C, the phase shifting element 100 may be connected to, or otherwise associated with, a signal path in order to provide phase-shifting (or "line stretching") within the signal path, and may be formed directly on a printed circuit board. In accordance with embodiments of the invention, once element 100 is connected to or associated with a signal path, the phase of a signal propagating along a signal path may be varied by varying the position of a tuning member 132 within a receiving space 128. Referring now to FIG. 4, the progressive phase shifting network 300 may be employed in a situation where it is desired to apply coordinated phase shifting or line stretching across multiple elements. In such a situation, a progressive phase shifting network 300 may be provided that comprises at least a same number of signal taps 256 as a number of antenna elements. The operation of the tuning array may apply a phase shift to each signal being supplied to each antenna element.

The devices described and/or depicted herein may be part of a multi-antenna element array operating over various frequency ranges, including CDMA-GSM (e.g., 698 to 960 Megahertz (MHz)), Advanced Wireless System (e.g., 1710-1755 MHz (at receiver), 2110-2155 MHz (at transmitter)), Personal Communications Service (1850-1910 MHz (at receiver), 1930-1990 MHz (at transmitter)), Digital Communications System (1710-1785 MHz (at receiver), 1805-1880 MHz (at transmitter))), Universal Mobile Telecommunication System, and Long Term Evolution (LTE) frequency bands (e.g., 1700 to 2700 MHz, or part a portion of the band such as 2490-2690 MHz which is TD LTE), for example. Further, the devices described and/or depicted herein may make use of a reduced number of individual components through the use of printed circuit boards, for example (i.e., a single printed circuit board comprises many elements).

Figure 5:
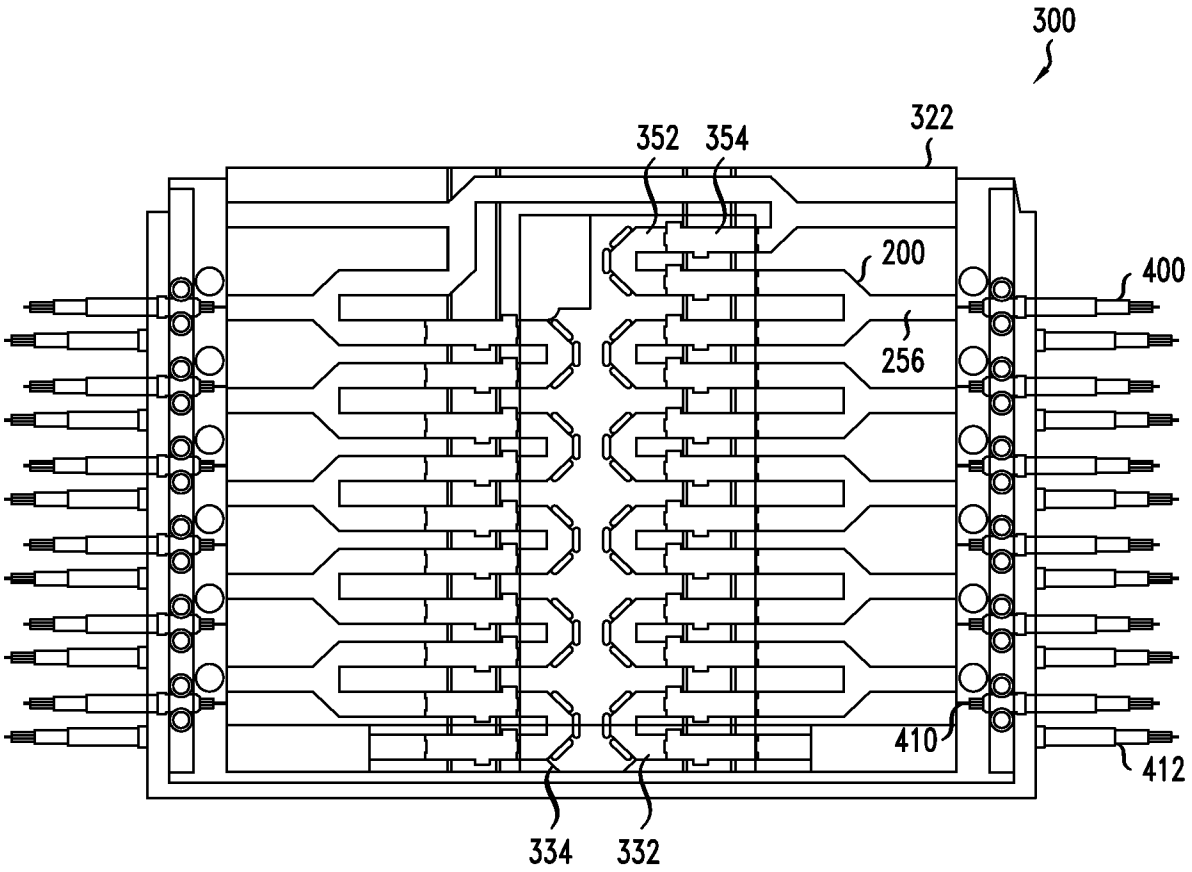
FIG. 5 is a perspective view of a phase shifting network comprising a plurality of phase shifting elements, including coaxial wiring connections to the phase shifting network.
Figure 6:
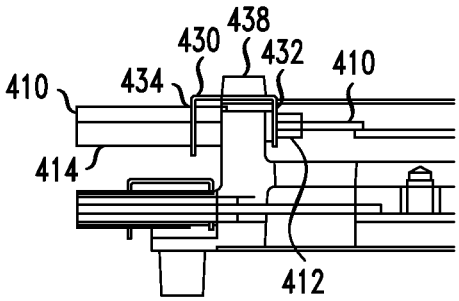
FIG. 6 is a detailed side view of a manner of connecting a coaxial cable to a power divider element within the phase shifting network.
Figure 7:
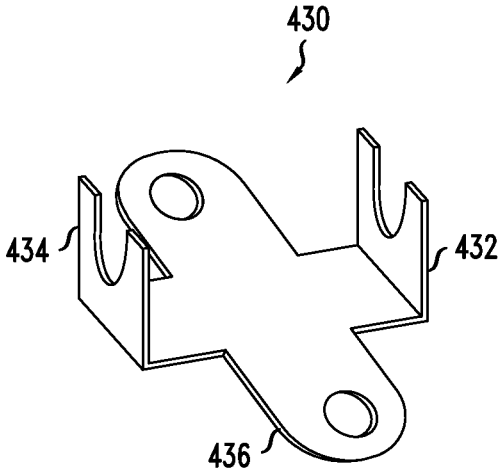
FIG. 7 is a perspective view of a coaxial cable fastening clip.

Conventionally, a signal wire 410 of the coaxial cable 400 as shown in FIG. 5 may be soldered to the signal tap 256, and a shield layer 412 may be soldered to a housing (not shown). However, the soldered connections along may not be very robust. Referring now to FIG. 5, in accordance with still further embodiments of the invention, a more robust connection of the shielding layer 412 may be obtained with the use of solder clips 430 (shown in FIG. 6) in the progressive phase shifting network 300. In this embodiment, the plurality of power divider elements 200 may be configured substantially side-by-side on a first circuit board 322. The elements 200 may comprise a plurality of tuning elements 332. As with the power divider elements 200, only a few tuning elements 332 have been labeled in FIG. 5, it being understood that many more are depicted, but not labeled, in the embodiment shown in FIG. 5. Each of the tuning elements 332 may comprise a pair of electrically conducting arms oriented parallel to one another, with each arm having first and second ends 352, 354, where the first ends 352 of a pair of arms may be electrically connected to one another. That is, each of the plurality of tuning elements 332 may generally define a "U" shaped conductor. In accordance with an embodiment of the invention, the tuning elements 332 may be formed together on a single, second circuit board 334, where the arms of the second circuit board 334 may extend from a side edge of the second circuit board 334. Clips 430 may improve the mechanical (as well as electrical) connection, reduce instances of failures of a soldered connection and reduce the chances that a connection between a shielding layer 412 (shown in FIGS. 5 and 6) and housing will be broken. In an embodiment shown in FIG. 7, the clips 430 may be sheet metal elements, and may comprise downward bent front end 432 and downward bent rear end 434. The clips 430 may comprise channels to fit over the coaxial cable 400. The front end 432 (that is, an end of the clip 430 oriented closest to the end of the coaxial cable 400) may be soldered to the shielding layer 412, while the rear end 434 may be clipped onto a coaxial cable insulating jacket 414 (shown in FIG. 6). In addition to improving mounting and electrical connection of the signal wire 410 and shielding layer 412, the solder clips 430 may also provide stress relief for the coaxial cables 400, reducing the possible loosening of the coaxial cables over time. One or more mounting elements 436, such as holes or tabs or the like, may be formed through the top surface of the clips 430 to accommodate mounting or clamping screws 438 (shown in FIG. 6).

It will be understood that the above-described embodiments of the invention are illustrative in nature, and that modifications to such embodiments may occur to those skilled in the art without departing from the scope and spirit of the invention as defined by the appended claims. Further, related methods making use of the inventive embodiments described herein are intended to be included within the scope and spirit of the invention. Accordingly, the invention is not to be regarded as limited to the embodiments disclosed herein. Instead, the scope of the present invention is as set forth in the appended claims.

What is claimed is:

1. A phase shifting circuit element, comprising:

a circuit board comprising a surface, and an elongated electrically conductive path on the surface;

a cover disposed over and electrically connected to the conductive path, the cover comprising a substantially planar conductive metal sheet with a bottom surface substantially separated from the electrically conductive path by a plurality of stand-off feet at edges thereof and configured for mounting the metal sheet to the circuit board for defining an elongated receiving space there between; and an electrically conductive tuning member slidably receivable within the receiving space.

2. The phase shifting circuit element according to claim 1, wherein the tuning member is electrically coupled to the conductive path.

3. The phase shifting circuit element according to claim 1, wherein the tuning member is capacitively coupled to the conductive path.

4. The phase shifting circuit element according to claim 1, wherein the tuning member comprises a circuit board substrate, the substrate comprises another electrically conductive path on a surface of the substrate.

5. The phase shifting circuit element according to claim 1 further comprising an insulating layer for covering the electrically conductive path.

6. The phase shifting circuit element according to claim 5, wherein the insulating layer comprises a dielectric insulator.

7. The phase shifting circuit element according to claim 1 further comprising an insulating layer for covering the bottom surface of the cover.

8. The phase shifting circuit element according to claim 7, wherein the insulating layer comprises a dielectric insulator.

9. A method for providing phase adjustments in a multi-element antenna array, comprising:

configuring a first circuit board comprising a surface;

forming a plurality of power dividers substantially side-by-side on the surface, each of the power dividers comprising:

a pair of parallel elongated electrically conductive paths formed on the surface, the conductive paths being oriented parallel to one another and comprising first and second ends, the first ends being electrically connected to one another and to a signal tap; and a capacitive cover disposed over, and electrically connected to, each of the electrically conductive paths, each capacitive cover respectively comprising a substantially planar metal sheet with a bottom surface substantially separated from a corresponding electrically conductive path by a plurality of stand-off feet at edges thereof configured for mounting the respective metal sheet to the first circuit board to define an elongated receiving space there between;

configuring a second circuit board comprising a surface and a side edge; and configuring a plurality of tuning elements formed on the second circuit board to serially connect the power dividers, each of the tuning elements comprising a pair of electrically conducting arms extending from the side edge, the arms being oriented parallel to one another and operable to slidably move into receiving spaces of the power dividers and comprising first and second ends, the first ends being electrically connected to one another.

10. A phase shifting circuit network, comprising:

a first circuit board comprising a surface;

a plurality of power dividers formed substantially side-by-side on the surface, each of the power dividers comprising:

a pair of parallel elongated electrically conductive paths formed on the surface, the conductive paths being oriented parallel to one another and comprising first and second ends, the first ends being electrically connected to one another and to a signal tap; and a respective capacitive cover disposed over, and electrically connected to, each of the electrically conductive paths, each capacitive cover respectively comprising a substantially planar conductive metal sheet with a bottom surface substantially separated from a corresponding electrically conductive path by a plurality of standoff feet at edges thereof configured to mount the respective metal sheet to the first circuit board and to define an elongated receiving space there between;

a second circuit board comprising a surface and a side edge; and a plurality of tuning elements formed on the second circuit board, each of the tuning elements comprising:

a pair of electrically conducting arms extending from the side edge, the arms being oriented parallel to one another and comprising first and second ends, the first ends being electrically connected to one another.

11. The phase shifting circuit network according to claim 10, wherein the arms of the tuning elements are operable to slidably move into receiving spaces of the power dividers.

12. The phase shifting circuit network according to claim 11, wherein each arm of a tuning element is operable to move into a receiving space of a different one of two adjacent power dividers.

13. The phase shifting circuit network according to claim 12, wherein the received tuning elements serially connect the power dividers to form a serial array of the power dividers.

14. The phase shifting circuit network according to claim 10, wherein said plurality of power dividers comprises a first set of power dividers disposed along a first edge of the circuit board, and a second set of power dividers disposed along an opposite second edge of the circuit board, the first and second sets of power dividers configured in a mirror-image arrangement such that receiving spaces, of the power dividers of the first set, face inward toward receiving spaces of the power dividers of the second set.

15. The phase shifting circuit network according to claim 10, wherein the plurality of tuning elements formed on the second circuit board comprises a first set of tuning elements comprising electrically conducting arms extending outward from a first side edge of the second circuit board, and a second set of tuning elements comprising electrically conducting arms extending outward from a second side edge of the circuit board opposite the first side edge.

16. The phase shifting circuit network according to claim 10, further comprising a housing substantially enclosing the first and second circuit boards.

17. The phase shifting circuit network according to claim 10, further comprising a plurality of coaxial cable mounting clips corresponding to the signal taps, each coaxial cable mounting clip comprising a sheet metal strip having downward bent front and rear ends and channels to fit over a corresponding coaxial cable.

18. The phase shifting circuit network according to claim 17, wherein for each coaxial cable mounting clip the front end comprises a soldered connection to a shielding layer of the corresponding coaxial cable, and the rear end comprises a clipped on connection to an insulating jacket of the corresponding coaxial cable.

19. The phase shifting circuit network according to claim 18, further comprising one or more mounting elements on a top surface of the clips to accommodate mounting or clamping screws.

* * * * *